United States Patent [19]

Inoue et al.

[11] Patent Number: 4,789,618

[45] Date of Patent: Dec. 6, 1988

[54] SILVER HALIDE PHOTOGRAPHIC MATERIAL AND VERY HIGH CONTRAST NEGATIVE IMAGE-FORMING PROCESS USING SAME

[75] Inventors: Nobuaki Inoue; Senzo Sasaoka; Toshiro Takahashi, all of Kanagawa, Japan

[73] Assignee: Fuji Photo Film Co., Ltd., Kanagawa, Japan

[21] Appl. No.: 860,402

[22] Filed: May 7, 1986

[30] Foreign Application Priority Data

May 9, 1985 [JP] Japan ..... 60-098720

[51] Int. Cl.[4] ..... G03C 1/06; G03C 1/08; G03C 5/26

[52] U.S. Cl. ..... 430/264; 430/265; 430/569; 430/599

[58] Field of Search ..... 430/446, 447, 448, 264, 430/267, 608, 613, 599, 603, 265, 569

[56] References Cited

U.S. PATENT DOCUMENTS

| | | | |
|---|---|---|---|
| 3,748,130 | 7/1973 | Hoffman et al. | 430/608 |
| 3,957,490 | 5/1976 | Libeey et al. | 430/599 |
| 4,221,857 | 9/1980 | Okutsu et al. | 430/448 |
| 4,224,401 | 9/1980 | Takada et al. | 430/448 |
| 4,269,929 | 5/1981 | Nothnagle | 430/264 |
| 4,328,302 | 5/1982 | Nishimura et al. | 430/264 |
| 4,468,454 | 8/1984 | Brown | 430/569 |
| 4,478,928 | 10/1984 | Hess et al. | 430/599 |

*Primary Examiner*—Won H. Louie

*Attorney, Agent, or Firm*—Sughrue, Mion, Zinn, Macpeak & Seas

[57] ABSTRACT

A silver halide photographic material having on a support at least one silver halide emulsion layer is disclosed, wherein the silver halide emulsion layer comprises a silver halide emulsion containing an oxidizing agent added thereto before chemical ripening of the emulsion, and the silver halide emulsion or a hydrophilic colloid layer contains a hydrazine derivative.

17 Claims, No Drawings

SILVER HALIDE PHOTOGRAPHIC MATERIAL AND VERY HIGH CONTRAST NEGATIVE IMAGE-FORMING PROCESS USING SAME

FIELD OF THE INVENTION

This invention relates to a silver halide photographic material and a very high contrast negative image-forming process using it. More particularly, the invention relates to a silver halide photographic light-sensitive material which is used for a photographic process of making printing plates and to a very high contrast negative image-forming process using the material.

BACKGROUND OF THE INVENTION

In the field of graphic arts, an image-forming system showing very high contrast (in particular, showing gamma of 10 or higher) photographic characteristics is required for improving the reproduction of continuous tone images or line images by dot images.

Hitherto, for the above-described purpose, a specific developer called "lith-developer" has been used. The lith-developer contains hydroquinone only as the developing agent and further contains a sulfite as a preservative for not hindering the infectious developing property thereof in the form of an addition product thereof with formaldehyde for greatly lowering (usually not higher than 0.1 mole/liter) the concentration of the free sulfite ion. Accordingly, the lith-developer has a very serious disadvantage that the lith-developer is very liable to be air-oxidized and thus cannot endure storage over 3 days.

In order to obtain high contrast photographic characteristics, there are processes of using hydrazine derivatives described in U.S. Pat. Nos. 4,224,401, 4,168,977, 4,166,742, 4,311,781, 4,272,606, 4,211,857, 4,243,739, etc. According to these processes, photographic characteristics having very high contrast and high sensitivity are obtained and further since a sulfite can be added to the developer at a high concentration, the stability of the developer with respect to air oxidation is greatly improved as compared with the lith-developer.

However, the above-described image-forming system using hydrazine derivatives gives very high sensitivity and contrast and at the same time causes an undesirable phenomenon called "black spot" by infectious development, which becomes a large problem in the photographic process of making printing plates. "Black spot" (sometimes called "black pepper") is a dark spot which occurs at non-developed portions between dot images. The black spot increases where light-sensitive materials are stored, in particular under high temperature and high humidity, and also frequently occurs due to a reduction in the concentration of a sulfite ion generally used as a preservative. This defect also occurs due to an increase of pH value caused by the fatigue of the developer with the passage of time, which results in greatly lowering the commercial value of the light-sensitive materials used in the photographic process for making printing plates. Accordingly, intensive research has been conducted towards eliminating the occurrence of the black spot, but improvements heretofore have been accompanied by a reduction in sensitivity and gamma ($\gamma$). Hence, a system capable of improving the occurrence of the black spot while keeping high sensitivity and high contrast has been keenly desired.

SUMMARY OF THE INVENTION

An object of this invention is, therefore, to provide a silver halide photographic material having photographic characteristics of very high sensitivity and contrast over 10, measured in gamma ($\gamma$), using a stable developer and causing occurrence of less black spot and also an image-forming process using the photographic material.

It has now been discovered that the above-described object can be attained by the invention as set forth herein.

That is, this invention provides a silver halide photographic material having on a support at least one silver halide emulsion layer, in which the silver halide emulsion layer comprises a silver halide emulsion containing an oxidizing agent added thereto before a chemical ripening step during the production of the silver halide emulsion which involves a precipitation step, (optionally a physical ripening step), a water-washing step, and a chemical ripening step, and also the silver halide emulsion layer or a hydrophilic colloid layer contains a hydrazine derivative.

Furthermore, according to another embodiment of this invention, there is provided a process of forming very high (or super) contrast negative images by imagewise-exposing the above-described silver halide photographic material and then processing it with a developer containing at least 0.15 mole/liter of a sulfite ion and having a pH of 10.5 to 12.3.

DETAILED DESCRIPTION OF THE INVENTION

The oxidizing agent for use in this invention includes inorganic oxidizing agents such as hydrogen peroxide (aqueous solution), addition products of hydrogen peroxide (e.g., $NaBO_2.H_2O_2.3H_2O$, $2Na_2CO_3.3H_2O_2$, $Na_4P_2O_7.2H_2O_2$, $2Na_2SO_4.H_2O_2.2H_2O$), etc.), peroxy acid salts (e.g., $K_2S_2O_8$, $K_2C_2O_6$, $K_4P_2O_8$, etc.), peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2O_4)_2.6H_2O$, etc.), permanganates (e.g., $KMnO_4$, etc.), and chromates (e.g., oxyacid salts such as $K_2Cr_2O_7$, etc.) and organic oxidizing agents such as organic peroxides (e.g., peracetic acid, perbenzoic acid, etc.), etc.

Also, as other oxidizing agents, oxidizing gases (e.g., ozone, oxygen gas, etc.), oxidizing compounds releasing halogen (e.g., sodium hypochlorite, N-bromosuccinimide, N-bromoacetamide, N-chloroacetamide, N-bromophthalimide, N-bromomaleinimide, etc.), etc., can be used in this invention.

Examples of preferred oxidizing agents in this invention are hydrogen peroxide, the addition products thereof, peroxy acid salts, peroxy complex compounds, and halogen-releasing oxidizing compounds such as N-bromosuccinimide, etc., with hydrogen peroxide and the addition products thereof being particularly preferred.

The oxidizing agent in this invention may be added as a solution in water or an organic solvent miscible with water (e.g., alcohols, ethers, glycols, esters, etc.) and the addition amount thereof may be controlled according to the nature of the oxidizing agent but is preferably $1\times10^{-6}$ to 10 moles, more preferably $1\times10^{-5}$ to 1 mole, particularly preferably $1\times10^{-5}$ to $1\times10^{-1}$ mole, per mole of the silver halide in the silver halide emulsion layer.

The oxidizing agent may be added to a silver halide emulsion at any period from the formation of the silver halide crystals and directly before chemical ripening step but the preferred addition period is after the formation of the silver halide grains and before water-washing thereof.

It is known to use an oxidizing agent for preventing the formation of fog of silver halide emulsions. For example, in a heat-developable light-sensitive material, it is known to use a halogen-releasing type oxidizing agent for a step called halogenation when preparing silver halide crystals from the silver salt of a carboxylic acid. Also, in ordinary silver halide emulsions and the above-described heat-developable light-sensitive materials, it is known to add an oxidizing agent for the prevention of fog formation as described, for example, in Japanese Patent Publication Nos. 40484/78 and 35488/79, Japanese Patent Application (OPI) Nos. 4821/77, 10724/74, and 45718/74 (the term "OPI" as used herein refers to a "published unexamined Japanese patent application").

Also, Japanese Patent Publication No. 41056/76 discloses that the formation of fog can be inhibited by the addition of a compound having a nitrogen-halogen covalent bond during the chemical ripening of the silver halide emulsion. However, the addition period, as well as the purpose and the effect of the oxidizing agent in the known techniques are different from the addition period, the purpose, and the effect of an oxidizing agent in this invention. For example, in the above-described invention, the addition of the oxidizing agent gives the effect of preventing the formation of fog but frequently results in a reduction in sensitivity and a reduction in contrast but by the combination of an oxidizing agent and a hydrazine derivative in the present invention, the formation of black spot is prevented and also the contrast is greatly increased, which are utterly unexpected effects.

As the hydrazine derivative for use in this invention, there are the hydrazine derivatives having a sulfinyl group described in U.S. Pat. No. 4,478,928 which is herein incorporated by reference and compounds represented by the following general formula (I):

$$R_1\text{—NHNH—CHO} \qquad (I)$$

wherein $R_1$ represents an aliphatic group or an aromatic group.

The aliphatic group shown by $R_1$ in general formula (I) has preferably 1 to 30 carbon atoms and is, in particular, a straight chain, branched or cyclic alkyl group having 1 to 20 carbon atoms. The branched alkyl group may be cyclized to form a saturated heterocyclic ring containing at least one hetero atom in the ring. Also, the alkyl group may have a substituent such as an aryl group, an alkoxy group, a sulfoxy group, a sulfonamido group, a carbonamido group, etc. and the substituent preferably has up to 20 carbon atoms.

Specific examples of aliphatic groups shown by $R_1$ are a t-butyl group, a n-octyl group, a t-octyl group, a cyclohexyl group, a pyrrolidyl group, an imidazolyl group, a tetrahydrofuryl group, a morpholino group, etc.

The aromatic group shown by $R_1$ in general formula (I) is a monocyclic or dicyclic aryl group or an unsaturated heterocyclic ring group. The unsaturated heterocyclic ring group may form a heterocyclic aryl group by condensing with a monocyclic or dicyclic aryl group.

Specific examples of aromatic groups shown by $R_1$ are a benzene ring, a naphthalene ring, a pyridine ring, a pyridimine ring, an imidazole ring, a pyrazole ring, a quinoline ring, an isoquinoline ring, a benzimidazole ring, a thiazole ring, a benzothiazole ring, etc.; among these rings, those containing a benzene ring are preferred.

The particularly preferred aromatic group shown by $R_1$ is an aryl group. The aromatic group shown by $R_1$ may have a substituent. Specific examples of the substituent are a straight chain, branched or cyclic alkyl group (preferably having 1 to 20 carbon atoms), an aralkyl group (monocyclic or dicyclic aralkyl group having an alkyl moiety of preferably 1 to 3 carbon atoms), an alkoxy group (preferably having 1 to 20 carbon atoms), a substituted amino group (preferably an amino group substituted by an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), etc. The substituent may also be a thioureido group, a thioamido group, a heterocyclic amino group (e.g., an imidazolidino group), or an imino group, which has preferably up to 20 carbon atoms.

The group shown by $R_1$ of general formula (I) described above may contain therein a ballast group which is usually used for immobile photographic additives for couplers, etc. The ballast group is a group having at least 8 carbon atoms and is relatively inactive with respect to photographic properties. Examples of the ballast group can be selected from alkyl groups, alkoxy groups, alkylphenoxy groups, etc.

The group shown by $R_1$ of general formula (I) may contain therein a group strengthening adsorption on the surfaces of silver halide grains. As such an adsorptive group, there are thiourea groups, heterocyclic thiamido groups, mercapto heterocyclic groups, triazole groups, etc., as described in U.S. Pat. No. 4,385,108.

The synthesis methods for the hydrazine derivatives of general formula (I) are described in Japanese Patent Application (OPI) Nos. 20921/78, 20922/78, 66732/78, 20318/78, etc.

In the case of incorporating the hydrazine derivative in the photographic light-sensitive material in this invention, it is preferred to incorporate it in the silver halide emulsion layer but it may be incorporated in other light-insensitive hydrophilic colloid layer(s) (e.g., protective layer, interlayer, filter layer, antihalation layer, etc.). Practically speaking, when the compound is water-soluble, the compound may be added to an aqueous solution of a hydrophilic colloid as an aqueous solution thereof or when the compound is sparingly soluble in water, it may be added thereto as a solution in an organic solvent miscible with water, such as alcohols, esters, ketones, etc. When the compound is added to a silver halide emulsion, it may be added thereto at any time from the initiation of chemical ripening to before coating on the support, but is preferably added between after the end of chemical ripening and before coating. It is particularly preferred to add the solution to the coating composition prepared for coating the silver halide emulsion.

It is preferred that the optimum content of the hydrazine derivative for use in this invention is selected according to the grain size and the halogen composition of the silver halide emulsion, the manner and extent of chemical sensitization, the relation between the layer to which the compound is added and the silver halide emulsion layer, the kind of antifogging compound used, etc., and the test method for the selection is well-known in the art. Usually, the hydrazine derivative is used in the range of $1\times10^{-6}$ to $1\times10^{-1}$ mole, particularly $1\times10^{-5}$ mole to $4\times10^{-2}$ mole, per mole of the silver halide in the silver halide emulsion layer.

Then, specific examples of the compound represented by general formula (I) above are shown below but the compounds contemplated for use in this invention are not limited to these examples.

I-1

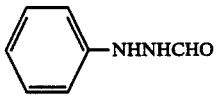

I-2

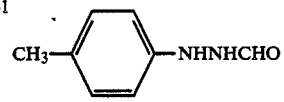

I-3

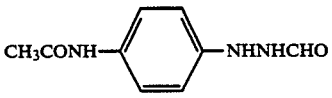

I-4

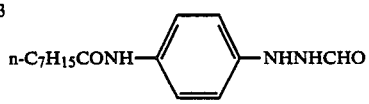

I-5

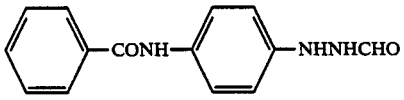

I-6

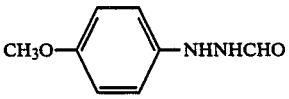

I-7

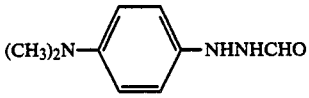

I-8

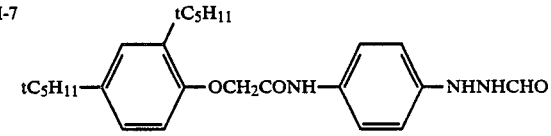

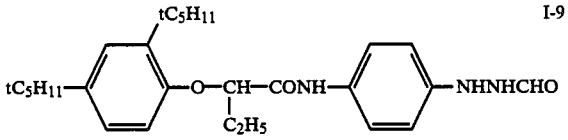

I-9

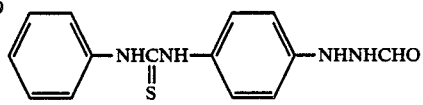

I-10

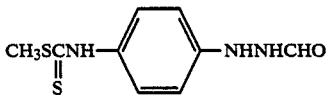

I-11

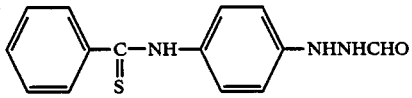

I-12

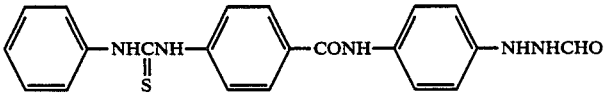

I-13

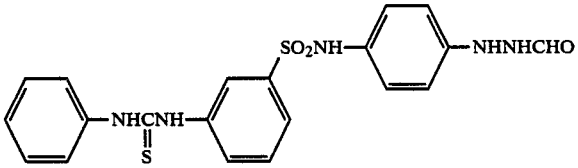

I-14

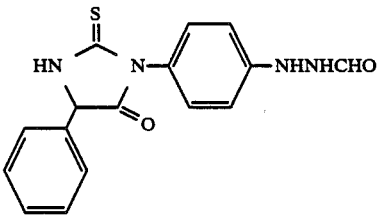

I-15

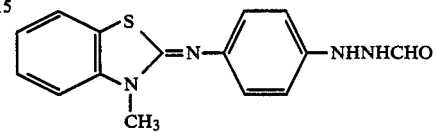

I-16

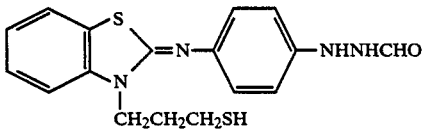

I-17

-continued
I-18
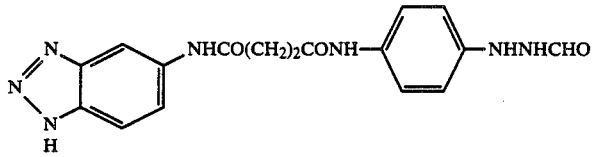
I-19
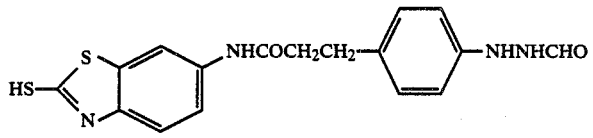
I-20
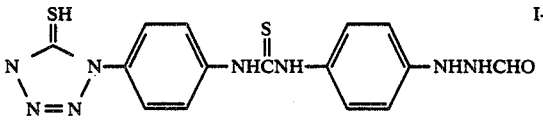
I-21
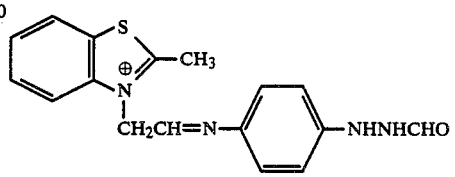
PTS⊖
(p-toluenesulfonate ion)
I-22
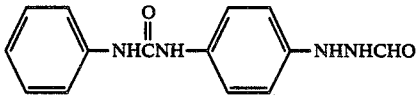
I-23
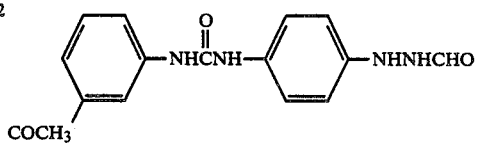
I-24
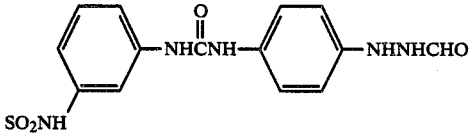
I-25
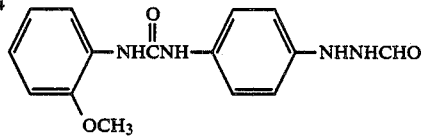
I-26
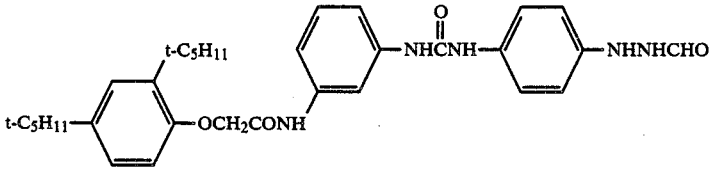
I-27
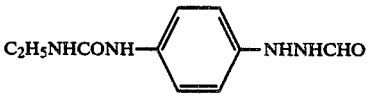
I-28
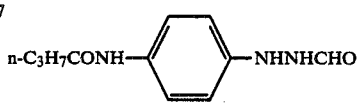
I-29
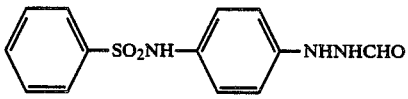
Other examples of hydrazine compounds useful in this invention are the following illustrated compounds containing sulfinyl groups as described in U.S. Pat. No. 4,478,928.
II-1
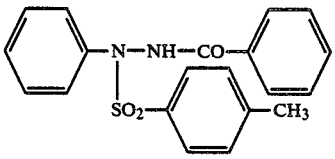
-continued
II-2
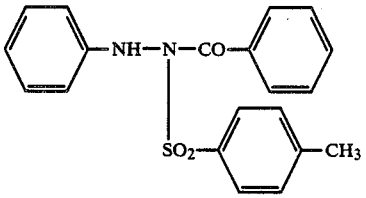

-continued

II-3

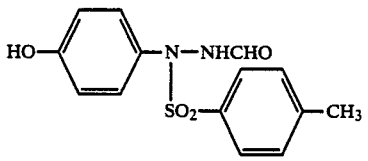

The silver halide emulsion for use in this invention may have a silver halide composition such as silver chloride, silver chlorobromide, silver iodobromide, silver iodochlorobromide, etc.

The mean grain size of the silver halide grains for use in this invention is preferably fine (e.g., not more than 0.7 μm), in particular, not more than 0.5 μm. Also, there is no particular restriction on the grain size distribution but it is preferred that the silver halide emulsion for use in this invention be of a mono-dispersed type. The term "mono-dispersed" type silver halide emulsion means an emulsion composed of silver halide grains wherein at least 95% thereof by weight or grain number have sizes within 40% of the mean grain size.

The silver halide grains in the photographic emulsion may have a regular crystal form such as cube, octahedron, etc., or an irregular crystal form such as sphere, tabular form, etc., or may have a composite form of these crystal forms.

The silver halide grains for use in this invention may have a uniform phase throughout the grains or may have a different phase between the inside thereof and the surface layer thereof. Moreover, two or more silver halide emulsions separately prepared may be used as a mixture thereof.

The silver halide emulsion for use in this invention may undergo formation of the silver halide grains or physical ripening in the presence of a cadmium salt, a sulfite, a lead salt, a thalium salt, a rhodium salt or a complex salt thereof, or an iridium salt or a complex salt thereof.

In this invention, the silver halide emulsion is particularly suitable for the light-sensitive materials for line image photographing or for dot images. It is preferred to use a silver halide emulsion produced in the presence of an iridium salt or a complex salt thereof in an amount of about $10^{-8}$ to $10^{-5}$ mole per mole of silver, preferably $5\times10^{-7}$ to $1\times10^{-6}$ mole per mole of silver, and composed of silver bromide in a proportion of not less than about 70 mole%, particularly not less than 90 mole%. Also, a silver haloiodide (e.g., AgBrI and AgBrClI) containing less than about 10 mole%, in particular 0.1 to 5 mole% silver iodide and having a silver iodide content on the surfaces of the grains larger than the silver iodide content of the mean grain. By using the silver halide emulsion containing such a silver haloiodide, photographic characteristics having high sensitivity and high contrast are obtained.

In the above-described case, it is preferred to add the above-described amount of the iridium salt to the silver halide emulsion before finishing physical ripening, in particular at the formation of the silver halide grains.

The iridium salt which is used in this case is a water-soluble iridium salt or iridium complex salt and includes iridium trichloride, iridium tetrachloride, potassium hexachloroiridate (III), potassium hexachloroiridate (IV), ammonium hexachloroiridate (III), etc.

This invention can be applied to a silver halide photographic material having greatly reduced sensitivity for improving handling thereof under ultraviolet-cut fluorescence lamp and a silver halide emulsion particularly suitable for use in this invention is produced in the presence of a rhodium salt or a complx salt thereof in an amount of $1\times10^{-6}$ to $1\times10^{-3}$ mole per mole of silver and is composed of preferably at least 50 mole% silver chloride, more preferably at least 70 mole% silver chloride, particularly at least 95 mole% silver chloride.

As the water-soluble rhodium salt for use in this invention, there are preferably rhodium chloride, rhodium trichloride, rhodium ammoniumchloride, etc. Furthermore, the complex salts of these salts can be used. The time of addition of the aforesaid rhodium salt to the silver halide emulsion is limited to the time before finishing physical ripening during the production of the silver halide emulsion and it is particularly preferred to add the rhodium salt thereto during the formation of the silver halide grains.

As the binder or protective colloid for the silver halide photographic emulsions in this invention, gelatin (limed gelatin, acid-treated gelatin, etc.) is advantageously used but other hydrophilic colloids can be also used in this invention. Examples of such hydrophilic colloids are proteins such as gelatin derivatives, graft polymers of gelatin and other polymers, e.g., albumin, casein, etc.; cellulose derivatives such as hydroxyethyl cellulose, carboxymethyl cellulose, cellulose sulfate esters, etc.; sugar derivatives such as sodium alginate, starch derivatives, etc.; and various synthetic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

The silver halide emulsion for use in this invention may or may not be chemically sensitized. As methods of chemically sensitizing a silver halide emulsion, it is known to use a sulfur sensitization, a reduction sensitization and a noble metal sensitization and they can be used solely or as a combination of them.

In the noble metal sensitizations, a gold sensitization is typical and a gold compound and a gold complex salt are mainly used. Complex salts of noble metals other than gold, such as platinum, palladium, rhodium, etc., can also be used. Specific examples thereof are described in U.S. Pat. No. 2,448,060, British Pat. No. 618,061, etc.

For the sulfur sensitization, a sulfur compound contained in gelatin and other various sulfur compounds such as thiosulfates, thioureas, thiazoles, rhodanines, etc., can be used.

For the reduction sensitization, stannous salts, amines, formamidinesulfinic acid, silane compounds, etc., can be used.

The photographic materials of this invention can contain the sensitizing dyes (e.g., cyanine dyes, merocyanine dyes, etc.) described in Japanese Patent Application (OPI) No. 52050/80, pages 45–53 for increasing the sensitivity thereof.

These sensitizing dyes may be used individually or as a combination thereof and a combination of sensitizing dyes is frequently used for super dye sensitization. The silver halide emulsion for use in this invention may further contain, in addition to a sensitizing dye, a dye having no spectral sensitizing action by itself or a material which does not substantially absorb visible light but shows a super sensitization.

The useful combination of sensitizing dyes, the dyes showing super sensitization, and materials showing super color sensitization are described in *Research Disclosure,* Vol. 176, RD No. 17643 (December 1978), Paragraph IV-J of page 23.

The photographic materials of this invention can further contain various compounds for preventing the formation of fog during the production, storage and photographic processing of the photographic materials or for stabilizing photographic properties. That is, there are many compounds known as antifoggants or stabilizers, such as azoles, for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketones such as oxazolinethione, etc.; azaindenes such as triazaindenes, tetraazaindenes (particularly 4-hydroxy-substituted (1,3,3a,7)-tetraazaindenes), pentaazaindenes, etc.; benzenethiosulfinic acid, benzenesulfinic acid, benzenesulfonic acid amide, etc. In these compounds, benzotriazoles (e.g., 5-methylbenzotriazole, etc.) and nitroindazoles (e.g., 5-nitroindazole, etc.) are preferred. Also, the aforesaid compound may be incorporated in a processing solution.

The photographic light-sensitive materials of this invention may contain an inorganic or organic hardening agent in the photographic emulsion layers or other hydrophilic colloid layers. Examples of these hardening agents are chromium salts (chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (mucochloric acid, mucophenoxychloric acid, etc.), etc. They can be used solely or as a combination thereof.

The photographic materials of this invention may further contain in the photographic emulsion layers or other hydrophilic colloid layers various surface active agents for the purposes of assisting coating, antistatic prevention, improving slidability, improved dispersibility, sticking prevention, and improving photographic properties (e.g., development acceleration, increasing contrast, increasing sensitivity, etc.), etc.

Examples of the surface active agents are nonionic surface active agents such as saponin (steroid series), alkylene oxide derivatives (e.g., polyethylene glycol, a polyethylene glycol/polypropylene glycol condensation product, a polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents containing an acid group (e.g., a carboxy group, a sulfo group, a phospho group, a sulfuric acid ester groups, a phosphoric acid ester group, etc.), such as alkylcarboxylates, alkylsulfonates, alkylbenzenesulfonates, alkylnaphthalenesulfonates, alkylsulfuric acid esters, alkylphosphoric acid esters, N-acty-N-alkyltaurines, sulfosuccinic acid esters, sulfoalkylpolyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic or aromatic quaternary ammonium salts, heterocyclic quaternary ammoniums salts (e.g., pyridiniums, imidazoliums, etc.), phosphonium salts or sulfonium salts containing aliphatic rings or heterocyclic rings, etc.

The surface active agents which are preferably used in this invention are the polyalkylene oxides having molecular weight of more than 600 described in Japanese Patent Publication No. 9412/83.

The photographic light-sensitive materials of this invention may further contain in the silver halide emulsion layer or other hydrophilic colloid layers a matting agent such as silica, magnesium oxide, polymethyl methacrylate, etc., for the purpose of preventing sticking.

Moreover, the photographic light-sensitive materials of this invention can contain a dispersion of a water-insoluble or sparingly soluble synthetic polymer matting agent for the improvement of dimensional stability, etc. Examples of the matting agent are polymers or copolymers composed of an alkyl (meth)acrylate, an alkoxyalkyl (meth)acrylate, glycidyl (meth)acrylate, (meth)acrylamide, a vinyl ester (e.g., vinyl acetate), acrylonitrile, olefin, styrene, etc., solely or as a combination thereof, or as a combination of the aforesaid monomer(s) and other monomer(s) such as acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

There is no particular restriction as to developing agents which may be used for the developer for developing the photographic light-sensitive materials of this invention, but dihydroxybenzenes are preferred. As the case may be, a combination of a dihydroxybenzene and a 1-phenyl-3-pyrazolidone or a combination of a dihydroxybenzene and a p-aminophenol may be used.

As a dihydroxybenzene developing agent for use in this invention, there are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., but hydroquinone is particularly preferred.

Also, examples of 1-phenyl-3-pyrazolidone or derivatives thereof, which are used for developing agents in this invention, are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

As the p-aminophenol series developing agent for use in this invention, there are N-methyl-p-aminophenol, p-aminophenol, N-($\beta$-hydroxyethyl)-p-aminophenol, N-(4-hydroxyphenyl)glycine, 2-methyl-p-aminophenol, p-benzylaminophenol, etc. In these compounds, N-methyl-p-aminophenol is preferred.

It is preferred that the developing agent is used in an amount of 0.05 mole/liter to 0.8 mole/liter. Also, in the case of using a combination of a dihydroxybenzene and a 1-phenyl-3-pyrazolidone or a p-aminophenol, it is preferred to use the former in an amount of 0.05 mole/liter to 0.5 mole/liter and the latter in an amount of not more than 0.06 mole/liter.

As sulfites which are used as preservatives in this invention, there are sodium sulfite, potassium sulfite, lithium sulfite, ammonium sulfite, sodium hydrogensulfite, potassium metahydrogensulfite, sodium formaldehydehydrogensulfite, etc. The amount of the sulfite is not less than 0.15 mole/liter, preferably not less than 0.4 mole/liter, in particular 0.5 mole/liter or more. Also, it is preferred that the upper limit thereof is 2.5 mole/liter.

Also, the alkali agent which is used for controlling the pH of the processing solution includes a pH controlling agent or a buffer such as sodium hydroxide, potassium hydroxide, sodium carbonate, potassium carbonate, sodium tertiary phosphate, potassium tertiary phosphate, etc. The pH of the developer is 10.5 to 12.3 and preferably 11.0 to 12.0.

As additives other than the above-described components, which can be also used in this invention, there are development inhibitors such as boric acid, borax, sodium bromide, potassium bromide, potassium iodide, etc.; organic solvents such as ethylene glycol, diethylene glycol, triethylene glycol, dimethylformamide, methylcellosolve, hexylene glycol, ethanol, methanol, etc.; antifoggants or black pepper preventing agents such as mercapto compounds (e.g., 1-phenyl-5-mercaptotetrazole, sodium 2-mercaptobenzimidazole-5-sulfonate, etc.), indazole series compounds (e.g., 5-nitroindazole, etc.), and benzotriazole series compounds (e.g., 5-methylbenzotriazole, etc.); etc. Furthermore, the processing solutions for use in this invention may also contain, if necessary, a color toning agent, a surface active agent, a defoaming agent, a water softener, a hardening agent, the amino compounds described in Japanese Patent Application (OPI) No. 106244/81, etc.

Then, the invention will be further explained in more detail by the following non-limiting examples. Unless otherwise indicated herein, all parts, percents, ratios and the like are by weight.

EXAMPLE 1

Emulsions I to IV were prepared by the following methods.

(Emulsion I)

A cubic mono-dispersed silver iodobromide emulsion having a mean grain size of 0.28 μm and containing 1 mole% silver iodide was prepared by simultaneously adding an aqueous solution of silver nitrate and an aqueous solution of potassium iodide and potassium bromide to an aqueous gelatin solution kept at 50° C. in the presence of potassium iridium (III) hexachloride present in an amount of $4\times10^{-7}$ mole per mole of silver and ammonia over a period of 60 minutes while maintaining the pAg thereof at 7.5 during the addition. Furthermore, while keeping the emulsion at 50° C., hydrogen peroxide was added to the emulsion in an amount of $5\times10^{-3}$ mole per mole of silver and the emulsion was ripened for 30 minutes. After removing soluble salts from the emulsion by washing the emulsion with water according to an ordinary manner, gelatin was added thereto and the emulsion was chemically sensitized with sodium thiosulfate to provide Emulsion I.

(Emulsion II)

By following the same procedure as the case of preparing Emulsion I except that $1.5\times10^{-4}$ mole per mole of silver of N-bromoacetamide was used in place of hydrogen peroxide, Emulsion II was obtained.

(Emulsion III)

By following the same procedure as the case of preparing Emulsion I except that hydrogen peroxide was not added, cubic mono-dispersed Emulsion III having a mean grain size of 0.28 μm and containing 1 mole% silver iodide was obtained.

(Emulsion IV)

By following the same procedure as the case of preparing Emulsion III except that the grain size was adjusted by reducing the amount of ammonia, cubic mono-dispersed Emulsion IV having a mean grain size of 0.26 μand containing 1 mole% silver iodide was obtained.

Then, after adding a sodium salt of 5,5'-dichloro-9-ethyl-3,3'-bis(3-sulfopropyl)oxacarbocyanine as a sensitizing dye, a dispersion of polyethyl acrylate, polyethylene glycol, 1,3-divinylsulfonyl-2-propanol, and Compound I-25 shown above to each of the emulsions thus prepared and the resultant mixture was coated on a polyethylene terephthalate film at a silver coverage of 3.4 g/m$^2$.

Each sample thus prepared was imagewise exposed, developed and the photographic characteristics were measured. The results thus obtained are shown in Table 1.

TABLE 1

| Sample No. | Emulsion | Amount of Compound I-25 per mole of Ag | Photographic Performance (A)* | (B)** | Black Spot |
|---|---|---|---|---|---|
| 1 | Emulsion I | $1.8\times10^{-4}$ mole | 93 | 15 | 4 |
| 2 | Emulsion I | $3.6\times10^{-4}$ mole | 100 | 15.5 | 3.5 |
| 3 | Emulsion II | $1.8\times10^{-4}$ mole | 89 | 15 | 4 |
| 4 | Emulsion II | $3.6\times10^{-4}$ mole | 95 | 16 | 3.5 |
| 5 | Emulsion III | $1.8\times10^{-4}$ mole | 100 | 12.5 | 2 |
| 6 | Emulsion III | $3.6\times10^{-4}$ mole | 105 | 13 | 2 |
| 7 | Emulsion IV | $1.8\times10^{-4}$ mole | 83 | 11 | 2.5 |
| 8 | Emulsion IV | $3.6\times10^{-4}$ mole | 89 | 12 | 2 |

*(A): Sensitivity; **(B): Contrast (γ)

From the results shown in Table 1 above, it can be seen that in Samples 1 to 4 of this invention, the contrast (γ) is high and the formation of black spot (black pepper) is greatly less as compared with Comparison Samples 5 to 8.

The sensitivity in the above table is a relative sensitivity shown by a relative value of the reciprocal of an exposure amount giving a density of 1.5 in a development for 30 seconds at 38° C., with the value of Sample 5 being defined as 100.

Also, the black spot in the table is evaluated in 5 grades by a microscopic observation, wherein grade "5" is best and grade "1" is worst in quality. Grades "5" and "4" are practically usable, grade "3" may be somehow practically usable although the quality is not good, and grades "2" and "1" are unsuitable for practical use. The grade between grade "2" and grade "3" is evaluated as "2.5".

The evaluation of the black spot is the result of developing each sample for 30 seconds at 38° C. when the pH of the developer is adjusted to 11.8.

In this case, the developer having the following composition was used.

(Composition of the Developer)

| | |
|---|---|
| Hydroquinone | 35.0 g |
| N—Methyl-p-aminophenyl ½ Sulfate | 0.8 g |
| Sodium Hydroxide | 9.0 g |
| Potassium Tertiary Phosphate | 74.0 g |
| Potassium Sulfite | 90.0 g |
| Ethylenediaminetetraacetic Acid Di-sodium Salt | 1.0 g |
| Potassium Bromide | 4.0 g |

-continued

| | |
|---|---|
| 5-Methylbenzotriazole | 0.5 g |
| 3-Diethylamino-1-propanol | 15.0 g |
| Water to make | 1 liter |

EXAMPLE 2

By following the same procedure as the case of preparing the samples in Example 1 except that Compound I-9 described hereinbefore was used for Emulsions I, III and IV in place of Compound I-25, Samples 9 to 13 were prepared. Each of the samples was imagewise exposed, developed, and the photographic performance was determined. The results thus obtained are shown in Table 2, from which it can be seen that Samples 9 and 10 of this invention are superior to Samples 11 to 13.

TABLE 2

| Sample No. | Emulsion | Amount of Compound I-9 per mole of Ag | Photographic Performance (A)* | (B)** | Black Spot |
|---|---|---|---|---|---|
| 9 | Emulsion I | $3.0 \times 10^{-3}$ mole | 89 | 17.5 | 4 |
| 10 | Emulsion I | $3.6 \times 10^{-3}$ mole | 95 | 19 | 3.5 |
| 11 | Emulsion III | $3.0 \times 10^{-3}$ mole | 100 | 15.5 | 2.5 |
| 12 | Emulsion III | $3.6 \times 10^{-3}$ mole | 105 | 16 | 2 |
| 13 | Emulsion IV | $3.6 \times 10^{-3}$ mole | 87 | 14.5 | 2.5 |

(A), (B), and the evaluation of black spot are the same as in Table 1 above. In addition, in the above relative sensitivity, the sensitivity of Sample 11 was defined as 100.

EXAMPLE 3

Emulsions V and VI were prepared in the following manner:

(Emulsion V)

A silver chlorobromide emulsion having a mean grain size of 0.20 μm and a bromine content of 5 mole% was prepared by simultaneously adding an aqueous silver nitrate solution and an aqueous solution of sodium chloride and potassium bromide to an aqueous gelatin solution kept in 40° C. in the presence of rhodium ammonium chloride present in an amount of $4.0 \times 10^{-5}$ mole per mole of silver. Then, while maintaining the emulsion at 40° C., an aqueous hydrogen peroxide solution was added to the emulsion in an amount of $5 \times 10^{-2}$ mole per mole of silver, and the emulsion was ripened for 30 minutes. After removing soluble salts from the emulsion by washing it with water according to an ordinary manner, gelatin was added to the emulsion and further 4-hydroxy-6-methyl-1,3,3a,7-tetraazaindene was added thereto as a stabilizer to provide Emulsion V.

(Emulsion VI)

By following the same procedure as the case of preparing Emulsion V except that the aqueous hydrogen peroxide solution was not added, Emulsion VI was prepared.

After adding to each of the emulsions thus prepared Compound I-25 in an amount shown in Table 3, a dispersion of polyethyl acrylate and 2-hydroxy-4,6-dichloro-1,3,5-triazine sodium salt were added to the emulsion and the resultant mixture was coated on a polyethylene terephthalate film at a silver coverage of 3.5 g/m² to provide Samples 14 to 17.

Each of the samples thus prepared was exposed through an optical wedge using a P-607 type printer, made by Dainippon Screen Mfg. Co., Ltd., developed with the developer as used in Example 1, and the photographic characteristics were determined. The results obtained are shown in Table 3.

TABLE 3

| Sample No. | Emulsion | Amount of Compound I-25 per mole of Ag | Photographic Performance (A)* | (B)** | Black Spot |
|---|---|---|---|---|---|
| 14 | Emulsion V | $2.5 \times 10^{-3}$ mole | 98 | 20 | 5 |
| 15 | Emulsion V | $3.0 \times 10^{-3}$ mole | 100 | 20 | 5 |
| 16 | Emulsion VI | $2.5 \times 10^{-3}$ mole | 100 | 15 | 5 |
| 17 | Emulsion VI | $3.0 \times 10^{-3}$ mole | 102 | 15.5 | 5 |

(A), (B), and the evaluation of black spot are the same as in Table 2, and the sensitivity of Sample 16 was defined as 100.

From the results shown in Table 3 above, it can be seen that in Samples 14 and 15 of this invention, the contrast is greatly increased by the addition of hydrogen peroxide during the preparation of the emulsion as compared with the Comparison samples 16 and 17. In addition, the formation of black spot are less in the samples of this invention and the comparison samples because of the use of a large amount of the rhodium salt.

As described above, by using the silver halide emulsion containing an oxidizing agent added thereto during the preparation of the emulsion and at least one of hydrazine derivatives as the compound shown by general formula (I) described above, high-sensitivity and high-contrast photographic characteristics effective for the reproduction of dot images and line images and causing less occurrence of black spot can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which yields a gamma of 10 or higher having on a support at least one silver halide emulsion layer, wherein the silver halide emulsion layer comprises a silver halide emulsion containing an oxidizing agent for the at least one silver halide emulsion added thereto before chemical ripening of the emulsion, and the silver halide emulsion layer or a hydrophilic colloid layer contains a hydrazine derivative added after chemical sensitization and represented by general formula (I):

$$R_1{=}NHNH{=}CHO \qquad (I)$$

wherein $R_1$ represents an aliphatic group or an aromatic group, wherein the oxidizing agent is added to the silver halide emulsion after physical ripening which is then subjected to oxidation, and water-washing followed by chemical sensitization.

2. The silver halide photographic material as claimed in claim 1, wherein the oxidizing agent is hydrogen peroxide.

3. The silver halide photographic material as claimed in claim 1, wherein the oxidizing agent is an addition product hydrogen peroxide, a peroxy acid salt or a peroxy complex compound.

4. The silver halide photographic material as claimed in claim 1, wherein the oxidizing agent is a halogen-releasing oxidizing compound.

5. The silver halide photographic material as claimed in claim 4, wherein the halogen-releasing oxidizing compound is N-bromosuccinimide.

6. The silver halide photographic material as claimed in claim 1, wherein the amount of the oxidizing agent added to the silver halide emulsion is $10^{-6}$ to 10 moles per mole of silver halide.

7. The silver halide photographic material as claimed in claim 6, wherein the amount of the oxidizing agent added to the silver halide emulsion is $10^{-5}$ to 1 mole per mole of silver halide.

8. The silver halide photographic material as claimed in claim 7, wherein the amount of the oxidizing agent added to the silver halide emulsion is $10^{-5}$ to $10^{-1}$ mole per mole of silver halide.

9. The silver halide photographic material as claimed in claim 1, wherein $R_1$ in the general formula (I) is an aryl group or a substituted aryl group.

10. The silver halide photographic material as claimed in claim 1, wherein the amount of the hydrazine derivative added to the silver halide emulsion layer or the hydrophilic colloid layer is $10^{-6}$ mole to $10^{-1}$ mole per mole of silver halide.

11. The silver halide photographic material as claimed in claim 10, wherein the amount of the hydrazine derivative added to the silver halide emulsion layer or the hydrophilic colloid layer is $10^{-5}$ mole to $4\times10^{-2}$ mole per mole of silver halide.

12. A process for forming a high contrast negative image having a gamma value of 10 or higher, which comprises imagewise exposing a silver halide photographic material having on a support at least one silver halide emulsion layer, in which the silver halide emulsion layer comprises a silver halide emulsion containing an oxidizing agent for the at least one silver halide emulsion added thereto before chemical ripening of the emulsion and the silver halide emulsion or a hydrophilic colloid layer contains a hydrazine derivative added after chemical sensitization and represented by general formula (I):

$$R_1{=}NHNH{=}CHO \qquad (I)$$

wherein $R_1$ represents an aliphatic group or an aromatic group, and then developing the photographic material with a developer containing at least 0.15 mole/liter of a sulfite ion and having a pH of 10.5 to 12.3, wherein the oxidizing agent is added to the silver halide emulsion after physical ripening which is then subjected to oxidation and water-washing followed by chemical desensitization.

13. The process as claimed in claim 12, wherein the developer has a pH of 11 to 12.

14. The process as claimed in claim 12, wherein the oxidizing agent is hydrogen peroxide.

15. The process as claimed in claim 12, wherein the amount of the oxidizing agent added to the silver halide emulsion is $10^{-6}$ to 10 moles per mole of silver halide.

16. The silver halide photographic material as claimed in claim 1 wherein the oxidizing agent is selected from the group consisting of hydrogen peroxide (aqueous solution), addition products of hydrogen peroxide, peroxy acid salts, peroxy complex compounds, permanganates, chromates, peracetic acid, perbenzoic acid, ozone, oxygen gas, sodium hypochlorite, N-bromosuccinimide, N-bromoacetamide, N-chloroacetamide, and N-bromophthalimide.

17. The process of claim 12, wherein the oxidizing agent is selected from the group consisting of hydrogen peroxide (aqueous solution), addition products of hydrogen peroxide, peroxy acid salts, peroxy complex compounds, permanganates, chromates, peracetic acid, perbenzoic acid, ozone, oxygen gas, sodium hypochlorite, N-bromosuccinimide, N-bromoacetamide, N-chloroacetamide, and N-bromophthalimide.

* * * * *

UNITED STATES PATENT AND TRADEMARK OFFICE

CERTIFICATE OF CORRECTION

PATENT NO. : 4,789,618

DATED : December 6, 1988

INVENTOR(S) : Inoue, et al

It is certified that error appears in the above-identified patent and that said Letters Patent is hereby corrected as shown below:

Column 16, line 46 delete "$R_1$=NHNH=CHO, and insert --$R_1$-NHNH-CHO--

Signed and Sealed this

Second Day of January, 1990

*Attest:*

JEFFREY M. SAMUELS

*Attesting Officer*

*Acting Commissioner of Patents and Trademarks*